United States Patent [19]

Capponi et al.

[11] 3,961,878

[45] June 8, 1976

[54] ELECTROSTATIC SPRAYING OF FIXING AGENTS

[75] Inventors: Miro Capponi, Muttenz, Switzerland; Jacques Moreau, Mulhouse, France

[73] Assignee: Sandoz Ltd., Basel, Switzerland

[22] Filed: Feb. 15, 1974

[21] Appl. No.: 443,076

[30] Foreign Application Priority Data

Feb. 16, 1973 Switzerland ..... 2324/73

[52] U.S. Cl. ..... 8/2; 8/73; 8/74; 8/DIG. 12

[51] Int. Cl.[2] ..... D06P 5/20

[58] Field of Search ..... 8/2, 73, 74, DIG. 12

[56] References Cited

UNITED STATES PATENTS

| | | | |
|---|---|---|---|
| 3,454,347 | 7/1969 | Leimbacher | 8/34 |
| 3,782,895 | 1/1974 | Goorhuis | 8/2 |

FOREIGN PATENTS OR APPLICATIONS

| | | | |
|---|---|---|---|
| 1,231,122 | 4/1960 | France | 8/2 |

*Primary Examiner*—M. J. Welsh

*Attorney, Agent, or Firm*—Gerald D. Sharkin; Richard E. Vila; Thomas C. Doyle

[57] ABSTRACT

The present invention relates to a method of chemically aftertreating dyed or printed textiles by electrostatically spraying the dyed or printed textiles with a developing or fixing agent.

9 Claims, No Drawings

ELECTROSTATIC SPRAYING OF FIXING AGENTS

The present invention relates to chemical aftertreatment of dyed or printed textiles.

The dyeing and printing of textiles frequently necessitates a chemical aftertreatment of the dye-stuff freshly applied to the textile goods. This applies in particular to dyeing or printing processes employing reactive dyes, vat dyes or leuco-sulphuric acid ester dyes which require a subsequent fixing or developing step.

Generally, such a procedure comprises dyeing or printing a textile material by a continuous method and subsequent drying with, for example, superheated steam, hot air, by application of an infrared process of a high-frequency method, etc. The textile thus dried, which with the continuous process will mostly be in the form of a band, is then conveyed through a bath which contains the chemical agent required for the development or fixation of the dye. Excess solution is expressed and the fabric is subjected to heat treatment, e.g., employing hot air, saturated or superheated steam, infrared radiation, high frequency etc. In certain cases fixation may also be effected by maintaining the goods on which the chemical substance for the development or fixation of the dyes has been applied, at room temperature for some time.

The application of the chemical substance for the development or fixation of the dye from a bath as described above has, however, several disadvantages. In the bath, the dye which only adheres to the surface of the fabric may come off the fabric and remain in the bath causing loss of dye and a soiling of any white parts of the fabric or a mutual soiling of the dyed parts resulting in reduced brightness.

Another disadvantage with the use of a fixing or developing bath is that the excess solution has to be removed, e.g., by expressing. Because of this padding method the clearness along the edges of a design is often lost and unintentional changes in shade often occur. To avoid these undesired effects the dyed or printed material has to be carefully dried.

It has previously been suggested to spray the textiles which are printed with reactive dyes with an alkali solution after they are printed and dried but prior to thermal treatment. The disadvantage with this method is that mechanical spraying of the alkali solution causes irregularities in the fabric and does not result in deep penetration as the spraying takes place only on the surface.

The present invention provides a process for the chemical aftertreatment of dyed or printed textiles comprising applying a developing or fixing agent thereto by means of electrostatic spraying.

The process of the invention may be carried out on textiles which have been dyed or printed with reactive dyes, vat dyes or leuco-sulphuric acid ester dyes.

The electrostatic spraying of the developing or fixing agent aqueous solution may be carried out according to conventional electrostatic spraying methods. The droplets are produced in an electrostatic field so as to provide them with a positive or negative charge. A suitable arrangement consists in having the spraying apparatuses together with an electrically charged pole located on one side of the textile to be treated and a pole with the opposite charge located on the other side of the textile material. Alternatively, the fabric may be passed between two spraying banks, each of which has a charge opposite to that of the other bank.

Conveniently, the solution is sprayed over the entire width of the textile while the electrostatic field is normal or substantially normal thereto. The quantity of the sprayed solution to be picked up by the textile depends on its concentration, the speed at which the textile is conveyed through the spraying apparatus and on the field strength and to a certain extent on the size of the droplets. Thus, the foregoing parameters are adjusted according to the quantity of dye and on the type of dye applied in dyeing or printing. It will be appreciated that with solutions of higher concentration, processing speed may be increased as is also possible when the output of the spraying jets is increased and the size of the droplets is decreased. In practice, this function can be controlled by an automatic device. Generally, spraying is carried out at room temperature. The size of the droplets is conveniently in the range of from approximately 20 to 30 m$\mu$. The concentration of the spraying solution depends on the other parameters, for example, speed at which fabric is conveyed through the field and on the nature of fixing or developing agent employed and on the nature of the dye which is to be fixed or developed. However, satisfactory results are usually obtained when the concentration is within the range of from 0.2 to 20%.

The electrostatic field is created by a potential difference which ranges from 30 to 150 kV, preferably from 50 to 120 kV. The distance between the two charged poles, or in the case where two banks of spraying jets are provided, the distance between the two banks, is conveniently approximately 20–70 cm, preferably 30–50 cm.

The speed at which the fabric is passed through the spraying apparatus may, conveniently, be in the range of from 5 to 15 m/minute.

The process of the invention can be employed for the aftertreatment of textiles of natural fibres such as wool, cotton, silk, or for the aftertreatment of semisynthetic fibres such as regenerated cellulose or textiles containing synthetic fibres such as are made of hydrocarbon polymers, e.g. polyethylene or polyisobutylene, or of vinyl compounds, e.g., polyvinyl acetate, polyacrylonitrile, or of polycondensation products such as polyamides, polyesters etc.

Where substrates dyed with reactive dyes are treated, suitable reactive dyes are listed in the Colour Index, Third Edition, 1971, vol. 3, pages 3391 to 3560.

Preferred fixing agents applied by the process of the invention for reactive dyes are alkaline-reacting acid acceptors, which fixing agents may be employed in concentrations ranging from 0.5 to 20%, preferably from 1 to 5%. Suitable such fixing agents include alkali hydroxides, alkali carbonates or bicarbonates, particularly NaOH, KOH, $Na_2CO_3$, $NaHCO_3$, $K_2CO_3$ and $KHCO_3$; ammonium carbonate may also be used.

Where substrates dyed with vat dyes are treated, the vat dyes described in the Colour Index, Third Edition, 1971, vol. 3, pages 3719 to 3844, may be employed. The fixing or developing agent for such dyes is suitably an alkaline-reacting substance such as an alkali hydroxide or carbonate, e.g., NaOH, KOH, $Na_2CO_3$ and $K_2CO_3$, which alkaline-reacting substance is employed together with a reducing agent, e.g., alkali hydrosulfite, or with a zinc formaldehyde sulphoxylate complex. The alkaline-reacting substance is suitably employed in a concentration of from 0.5 to 5%, preferably from 1 to 3% and the reducing agent in a concentration of from 0.2 to 10%, preferably from 1 to 6%.

When leuco-sulphuric acid esters are employed as dyes, the developing agent comprises a solution of a strong acid such as sulphuric acid together with an oxidizer, such as an alkali perborate or an alkali nitrite. The strong acid is suitably employed in a concentration of from 0.2 to 5%, preferably from 1 to 3% and the oxidizer in a concentration of from 0.1 to 3%, preferably from 0.3 to 1.5%. Preferably the oxidizer is sodium nitrite.

Suitable leuco-sulphuric acid esters are given in the Colour Index, Third Edition, 1971, vol. 3 pages 3649 to 3704.

In addition to the fixing or developing agents mentioned above the solution to be electrostatically sprayed may also contain electrolytes such as NaCl and $Na_2SO_4$ in a concentration ranging from 0.5% to 20%.

After the application of the fixing or developing agent the dye may be fixed by conventional methods, e.g., subjecting the fabric to heat treatment such as employing hot air, saturated or superheated steam. In some cases fixation may be achieved at room temperature.

The textiles may be dyed with a reactive dye, a vat dye or a leuco-sulphuric acid ester dye by conventional methods. Methods for dyeing with reactive dyes and vat dyes are described in E. R. Trotman, Dyeing and Chemical Technology of Textile Fibres, Griffin, London 1970 at page 520 to 543 and pages 474 to 505, respectively.

Due to the fact that the droplets of the developing or fixing agent when applied to the textile by a process according to the present invention exhibit a positive or negative charge and move within an electrostatic field a uniform distribution of the developing or fixing agent is achieved whilst allowing deep penetration of the droplets of the developing or fixing agent.

The following Examples serve to illustrate the invention.

EXAMPLE 1

A woven mercerized cotton fabric, weight 100 g/m², is printed with a compound of formula

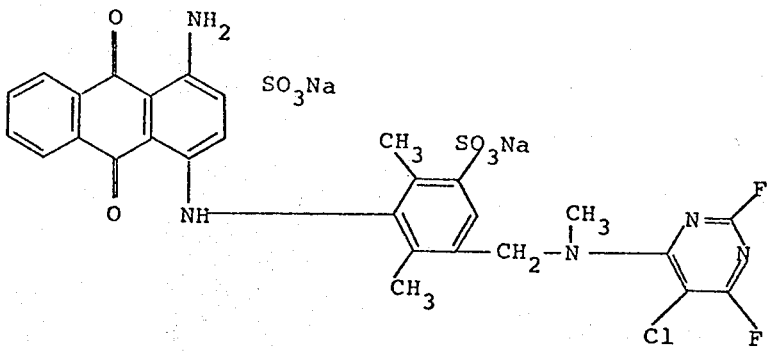

according to the awning printing method. The fabric is dried at 110°C for 60 seconds and connected to two earthed metal rods.

At a speed of 10 m/minute, the textile band passes two screens at a distance of 25 cm, each of the screens being fitted with 5 electrostatic jets regularly spaced from each other over a width of 1.5 m. A potential difference between the two screens of 50 kV is applied. An alkali solution containing 12 g/l sodium hydroxide and 50 g/l soda is electrostatically sprayed onto the fabric. The output of each jet is 20 liters/hour. As a result of the passage through the spraying zone the textile is impregnated with alkali solution in an amount of 56% of its own weight. Fixation is carried out in steam at 102°C for 2 minutes.

On washing, the printed parts of the textile exhibit a bright blue dyeing with excellent fastness properties.

EXAMPLE 2

A cotton gaberdine fabric, weighing 160 g/m², printed with a compound of formula

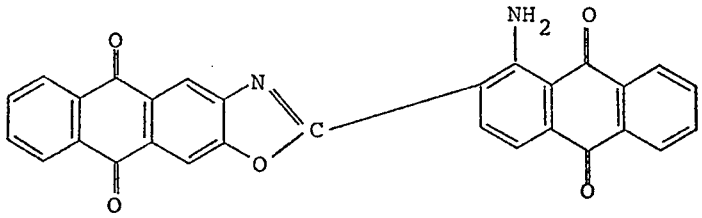

is passed through an electrostatic spraying installation such as described above in Example 1.

A solution containing 10 g/l sodium hydrosulfite and 18 g/l sodium hydroxide is sprayed onto the fabric. The spraying output of each jet is 36 liters/hour. As a result of the spraying the fabric picks up 50% of solution in relation to its own weight. Further processing takes place in a steamer for 1 minute, and the fabric is subsequently washed. The parts printed red have good fastness properties and the edge stands clearly out against the unprinted fabric without any signs of blurring.

EXAMPLE 3

A woven cotton fabric, weight 140 g/m², is printed with a compound of formula

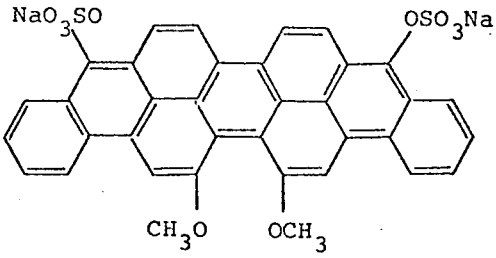

and dried. Employing an installation as is described in Example 1, a cold solution containing 15 g/l sulphuric acid and 5 g/l sodium nitrite is sprayed onto the fabric. The speed at which it is conveyed through the spraying zone is 8 m/minute and the spraying output of each jet is 18 liters/hour. On application of the solution the fabric is subjected to an air passage for 50 seconds and then immersed in a rinsing bath. After neutralization and saponification a bright green dyeing with sharp contours is obtained.

EXAMPLE 4

A blended fabric of 67% polyester and 33% cotton, mercerized, weight 165 g/m$^2$, is printed with a conventional printing paste containing 50 parts C.I. Disperse Red 121, liquid
30 parts C.I. Reactive Red 119
450 parts sodium alginate, 4%
10 parts sodium m-nitrobenzene sulphonic acid
460 parts water according to the rotary film printing method. The fabric is subsequently dried at 140°C for 45 seconds.

In a first phase the disperse-dye portion is fixed by a conventional method. Subsequently, the goods are conveyed through an electrostatic spraying installation as described in Example 1 at a speed of 15 m/minute. A solution of 40 g/l sodium bicarbonate is sprayed onto the fabric. The spraying capacity of each jet is 36 liters/hour. As a result of the spraying the fabric picks up approximately 50% solution in relation to its own weight.

Further processing takes place in a steamer at 102°C for 150 seconds. The goods are then washed in conventional manner.

The parts printed red exhibit good fastness properties and the edge stands clearly out against the unprinted fabric without any signs of blurring.

What is claimed is:

1. A process for fixing on a textile substrate a reactive dye which has been previously dyed or printed thereon which comprises applying to the dyed or printed substrate, in an electrostatic field, a spray consisting essentially of droplets of an aqueous solution of a fixing agent selected from the group consisting of alkali metal hydroxides, alkali metal carbonates, alkali metal bicarbonates and ammonium carbonate, said solution being of a concentration of 0.5 to 20%.

2. A process according to claim 1, in which the fixing agent is employed in a concentration range of from 1 to 5%.

3. A process according to claim 1, in which the electrostatic field is produced by a potential difference in the range of from 30 to 150 kV.

4. A process according to claim 3, in which the potential difference is in the range of from 50 to 120 kV.

5. A process according to claim 3 wherein the textile material is passed between oppositely charged poles which are 20–70 cm apart, one of said poles having a spraying apparatus associated therewith.

6. A process according to claim 3 wherein the textile material is passed between two spraying banks of opposite charge which are 20 to 70 cm apart.

7. A process according to claim 5 wherein the size of the droplets is in the range 20 to 30 m$\mu$.

8. A process according to claim 6 wherein the textile material is passed at a speed of 5 to 15 meters/minute.

9. A process according to claim 7 wherein the textile material is passed at a speed of 5 to 15 meters/minute.

* * * * *